US006112475A

United States Patent [19]

Truitt

[11] Patent Number: 6,112,475

[45] Date of Patent: Sep. 5, 2000

[54] KNEE BRACE BRACKET FOR TILT-UP CONSTRUCTION

[75] Inventor: Robert E. Truitt, Carson, Calif.

[73] Assignee: Dayton Superior Corporation, Miamisburg, Ohio

[ * ] Notice: This patent is subject to a terminal disclaimer.

[21] Appl. No.: 09/291,219

[22] Filed: Apr. 13, 1999

Related U.S. Application Data

[63] Continuation-in-part of application No. 09/084,544, May 26, 1998, Pat. No. 5,943,830.

[60] Provisional application No. 60/048,092, May 30, 1997.

[51] Int. Cl.[7] ..... E04G 25/00; E04G 25/04; E04H 12/20

[52] U.S. Cl. ..... 52/127.2; 52/126.3; 52/150; 52/151; 248/351; 248/354; 248/357; 269/904

[58] Field of Search ..... 52/127.2, 126.3, 52/149–151; 298/351, 354.1, 357; 269/904; 403/170, 174, 175

[56] References Cited

U.S. PATENT DOCUMENTS

| | | |
|---|---|---|
| 1,221,481 | 4/1917 | Selway . |
| 1,316,096 | 9/1919 | James . |
| 3,462,896 | 8/1969 | Lokensgaard . |
| 3,574,981 | 4/1971 | Henschen . |
| 3,798,856 | 3/1974 | Gloskowski . |
| 3,805,463 | 4/1974 | Lang et al. . |
| 3,920,232 | 11/1975 | Clark . |
| 4,068,427 | 1/1978 | Camardo . |
| 4,075,913 | 2/1978 | Tye . |
| 4,083,156 | 4/1978 | Tye . |
| 4,268,066 | 5/1981 | Davis . |
| 4,304,078 | 12/1981 | Meriwether, Jr. . |
| 4,872,634 | 10/1989 | Gillaspy et al. . |
| 4,890,473 | 1/1990 | Westerman . |
| 4,934,673 | 6/1990 | Bahler . |
| 5,943,830 | 8/1999 | Truitt ..... 52/127.2 |

FOREIGN PATENT DOCUMENTS

| | | |
|---|---|---|
| 168543 | 5/1959 | Sweden . |
| 218810 | 2/1968 | Sweden . |

OTHER PUBLICATIONS

Dayton Superior, "Tilt Up ConstructionHandbook", pp 42–44, Jan. 1990.

*Primary Examiner*—Robert Canfield
*Attorney, Agent, or Firm*—Biebel & French

[57] ABSTRACT

A knee brace bracket for use in a knee bracing system for tilt-up panel constructions. The knee brace bracket includes front and rear face members defining circular structures for extending around a main pipe brace which extends between a panel and a floor slab. The knee brace bracket is rigidly connected to a knee brace extending to a connection point on the panel. The knee brace bracket includes a plurality of rollers engaged with the main pipe brace whereby the main pipe brace is permitted to rotate within the knee brace bracket to permit a screw adjustment for the length of the main pipe brace.

15 Claims, 4 Drawing Sheets

KNEE BRACE BRACKET FOR TILT-UP CONSTRUCTION

CROSS-REFERENCE TO RELATED APPLICATIONS

This application is a continuation-in-part of U.S. application Ser. No. 09/084,544, filed May 26, 1998, now U.S. Pat. No. 5,943,830, which claims the benefit of Provisional Application Ser. No. 60/048,092, filed May 30, 1997.

BACKGROUND OF THE INVENTION

This invention relates generally to braces for use in tilt-up construction and, more particularly, to a knee brace bracket for use in a bracing structure for tilt-up construction wherein the knee brace bracket permits adjustment of the bracing structure to facilitate vertical alignment of a braced panel.

During construction using tilt-up panels, a brace structure is commonly provided to maintain the panels in a vertical position during construction, and prior to completion of the structure. One type of bracing structure comprises a tilt-up pipe brace having a foot plate for attachment to a floor surface and a wall plate for attachment to the wall surface, and an adjustable pipe member extending between the plates wherein the vertical orientation of the panel may be adjusted through adjustment of the pipe member length.

In addition to providing the above described bracing structure, a knee brace is also provided extending from a midpoint of the pipe member to a location on the panel, and is oriented generally perpendicular to the pipe member. In prior art constructions, the knee brace has been connected to the pipe member by means of a coupler or bracket wherein means are provided for clamping the bracket to both the knee brace and the pipe member to thereby rigidly connect the two members together. Further, the coupler for the knee brace is typically attached to a portion of the pipe member which is adapted to be rotated relative to a screw portion of the pipe member for adjustment of the pipe member length. Accordingly, in the past it has been difficult to adjust the vertical alignment of tilt-up panels after connection of the knee brace to the pipe member, since such an adjustment requires releasing the knee brace coupler from the pipe member, necessitating the use of a crane to hold the tilt-up panel during such an adjustment.

In order to provide brace stability, lateral braces of pipe often extend horizontally between successive bracing structures and are connected thereto adjacent respective knee brace couplers. Such lateral braces typically result in greater bracing structure complexity, in delays in construction, and in increased labor requirements. Further, access of equipment adjacent the braced panel is significantly restricted by the lateral braces. For example, the lateral braces must be removed to position mobile equipment next to the braced panel. The lateral braces must then be replaced when the equipment has completed its work.

Therefore, there is a need for a tilt-up construction bracing structure which permits adjustment of the bracing structure to facilitate alignment of a tilt-up panel. There is a further need for such a bracing structure wherein the structure is capable of providing bracing support to the panel during adjustment of the structure. Finally, there is a need for such a bracing structure which has increased stability thereby eliminating the need for additional lateral braces.

SUMMARY OF THE INVENTION

The present invention provides a knee bracing system and, more particularly, a knee brace bracket which is adapted to be attached to the end of a knee brace and which rotatably engages a pipe member defining a main brace extending between a tilt-up panel and a floor slab. The knee brace bracket includes a bracket frame pivotally supported on at least one connector having a slot or opening for receiving the end of a knee brace. Preferably, a pair of connectors are provided for receiving a pair of knee braces extending downwardly from the bracket frame such that the lower ends of the knee braces are fixed to the panel at spaced apart locations on opposite sides of a vertical plane containing the main brace and extending substantially perpendicular to the panel.

The bracket frame is defined by four semicircular side frames wherein two of the side frames form a front face member for the bracket frame and the other two side frames form a rear face member for the bracket frame. Four rollers are rotatably supported between the front and rear faces of the bracket frame wherein the rollers include surfaces for engaging the main brace whereby the main brace may be rotated relative to the bracket frame for adjustment of the length of the main brace.

Therefore, it is an object of the invention to provide a knee brace bracket which provides a connection between a main brace and a knee brace.

It is a further object of the invention to provide a knee brace bracket wherein the brace is adapted to rigidly hold the knee brace and main brace in engagement with each other while permitting rotation of the main brace.

It is another object of the invention to provide such a knee brace bracket which includes a pair of connectors by which a pair of knee braces may be utilized to provide additional stability to the knee bracing system.

Other objects and advantages of the invention will be apparent from the following description, the accompanying drawings and the appended claims.

DETAILED DESCRIPTION OF THE PREFERRED EMBODIMENT

Figure 1:
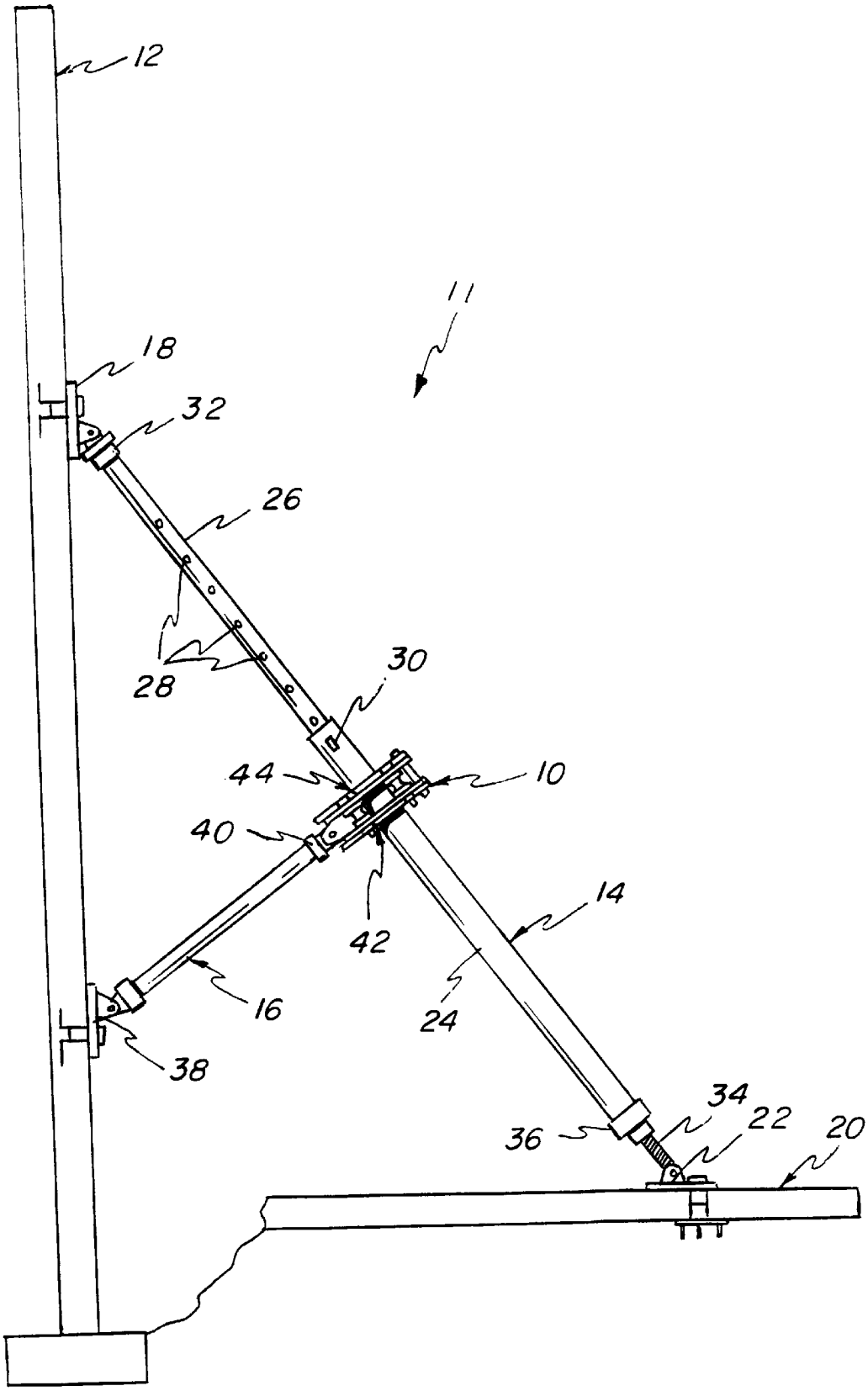
FIG. 1 is a side elevational view of the knee bracing system of the present invention showing the knee brace bracket in use connecting a knee brace to a main brace for supporting a tilt-up panel.

Referring to FIG. 1, the present invention provides a knee brace bracket 10 comprising part of a knee bracing system 11 for use in the erection of tilt-up panels 12. The bracket 10 is adapted to attach to a pipe member or main brace 14, and to a knee brace 16. In tilt-up constructions, the main brace 14 is typically pivotally attached to the panel 12 at a wall plate 18, and is pivotally attached to a floor slab 20 at a foot plate 22. Specifically, the main brace 14 preferably includes a first pipe 24, and a second pipe 26 received in telescoping relationship within the first pipe 24. The second pipe 26 is provided with a plurality of apertures 28 which are engaged by a pin 30 extending through an aperture in the first pipe 24 to generally align the pipes 24 and 26 to the appropriate overall length.

The second pipe 26 is attached to the wall plate 18 through a ball bearing coupler 32 to thereby permit rotation of the main brace 14 relative to the wall plate 18. In addition, the first pipe 24 is attached to the foot plate 22 through an adjusting screw 34 threadably engaged with a lower end 36 of the first pipe 24. Thus, rotation of the main brace 14 will cause adjustment of the length of the brace 14 between the wall plate 18 and foot plate 22 in order to obtain the desired vertical alignment of the panel 12.

The knee brace 16 of FIG. 1 is attached to the panel 12 at a further wall plate 38 located below the wall plate 18, and the knee brace 16 extends from the wall plate 38 to the main brace 14 at an angle of approximately 90° relative to the main brace 14. The knee brace 16 is rigidly attached to the knee brace bracket 10 at a socket member 40.

Figure 3:
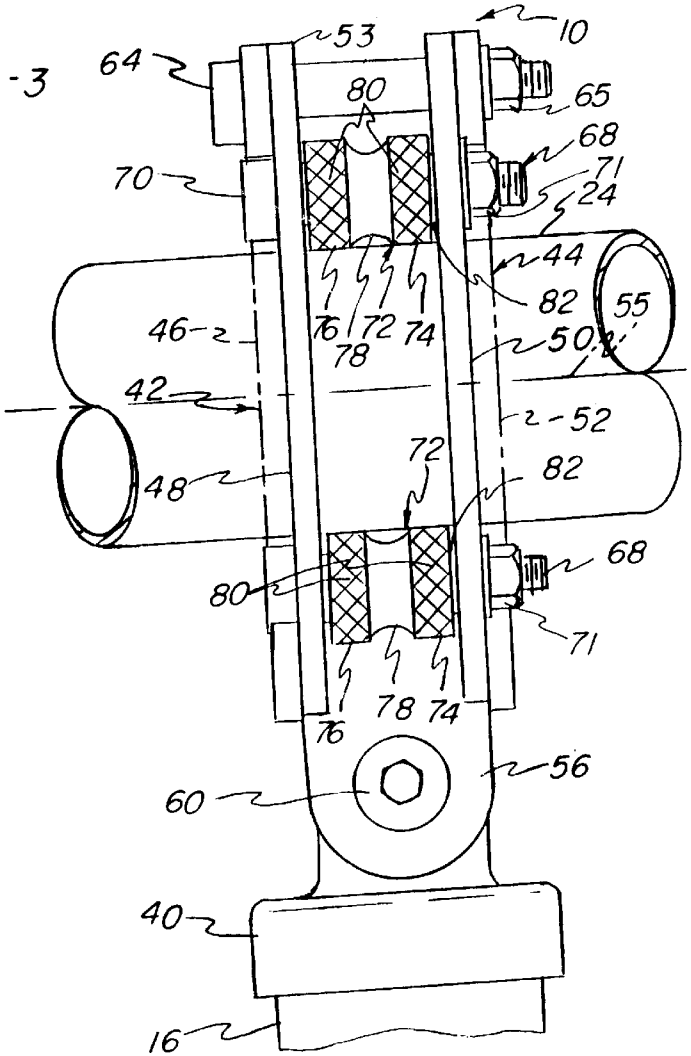
FIG. 3 is a side elevational view thereof.
Figure 2:
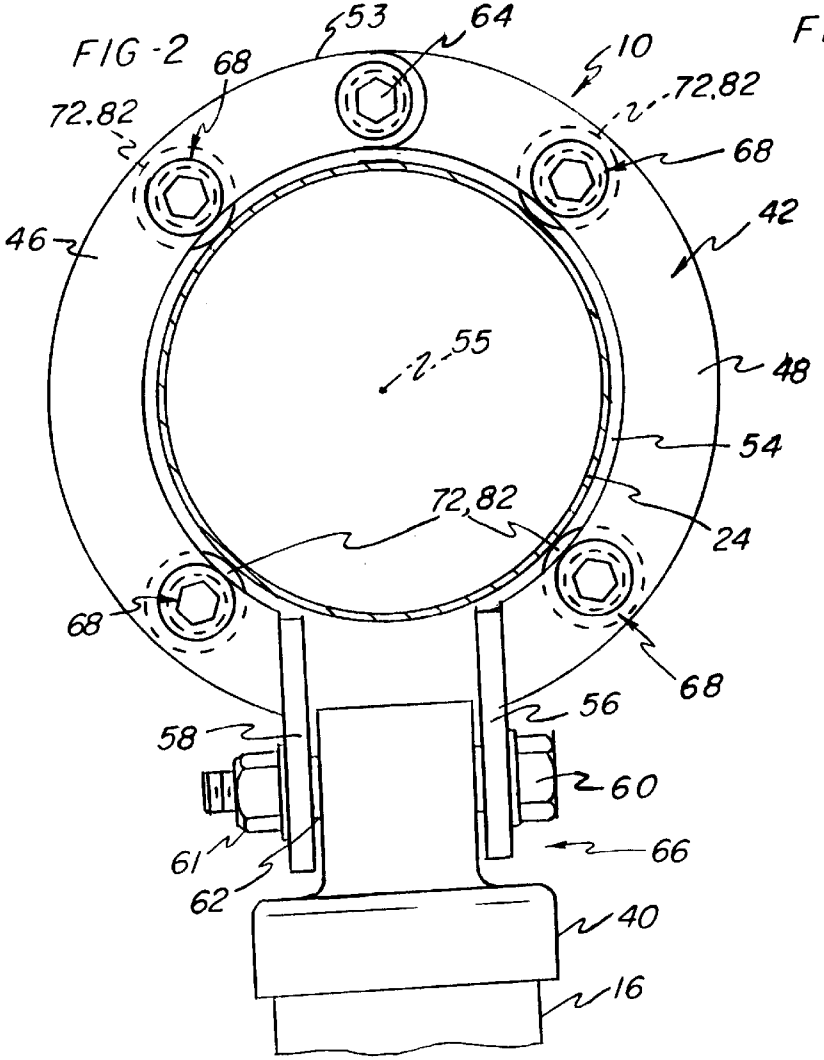
FIG. 2 is a front elevational view of the knee brace bracket of FIG. 1.

Referring now to FIGS. 2 and 3, the knee brace bracket 10 comprises a front face member 42 and rear face member 44 wherein the front and rear face members 42 and 44 are formed of identical constructions. The front face member 42 is formed of first and second identical, semicircular side frames 46, 48, and the rear face member 44 is similarly formed by identical, third and fourth semicircular side frames 50, 52. The side frames 46, 48 and 50, 52 define an annular bracket frame 53 having a circular passage 54 for receiving the first pipe 24 of the main brace 14. The passage 54 defines a longitudinal axis 55 coaxial with the longitudinal axis of the main brace 14.

The side frames 46, 48 and 50, 52 are each attached to connector plates 56 and 58 by welding, or an equivalent attachment means. The connector plates 56 and 58 are fixed relative each other by means of a bolt 60 which threadably engages a nut 61. A spacer sleeve 62 assists in determining the proper relative positioning between the connector plates 56 and 58. In addition, opposite ends of the side frames 46, 48 and 50, 52 are attached to each other by a shoulder bolt 64 and cooperating nut 65. The shoulder bolt 64 provides a pivot between the pairs of side frames 46, 48 and 50, 52.

A connector 66 is defined by the connector plates 56 and 58 and the socket member 40 which is pivotally supported by the bolt 60 and sleeve 62. The connector 66 allows pivotal movement of the side frames 46, 48 and 50, 52 relative to the socket member 40 about an axis defined by the bolt 60. In other words, the knee brace 16 is mounted for pivotal movement relative to the knee brace bracket 10 and main brace 14.

A plurality of roller structures 68 are provided in generally equally spaced circumferential relation around the longitudinal axis 55 of the passage 54. The roller structures 68 extend between the front and rear face members 42 and 44 around the periphery of the bracket 10. Each of the roller structures 68 includes a bolt 70 threadably engaging a nut 71 and rotatably supporting a roller 72 for rotational movement relative to the bracket frame 53. In addition, each roller 72 includes engagement surfaces 74, 76 separated by a groove 78. The engagement surfaces 74, 76 of the rollers 72 extend into the circular passage 54 for engagement with the first pipe 24 of the main brace 14.

Rotational movement of the rollers 72 permits rotation of the first pipe 24 relative to the knee brace bracket 10. The engagement surfaces 74, 76 simultaneously restrict movement of the knee brace bracket 10 along the longitudinal axis 55 relative to the main brace 14. In addition, it should be noted that the engagement surfaces 74, 76 may be provided with a knurled or other friction inducing surface 80 in order to further limit longitudinal movement of the knee brace bracket 10 along the length of the first pipe 24. Additionally, a spacer sleeve 82, around the bolts 68 between the side frames 50, 52 and rollers 72, provides the function of maintaining the spacing between the front and rear face members 42,44 around the circumference of the bracket 10.

In operation, the bolt 60 may be separated from the nut 61 and the bracket 10 to permit the side frames 46, 52 and 48, 50 to pivot relative to each other such that the engagement surfaces 74, 76 of the rollers 72 are moved outwardly away from the longitudinal axis 55 thereby facilitating placement of the bracket 10 around the first pipe 24 of the main brace 14. The connector plates 56, 58 may then be attached to the socket member 40 by means of the bolt 60 and the nut 61 whereby the knee brace bracket 10 is positively engaged around the main brace 14 to complete the assembly of the knee bracing system 11 for supporting a tilt-up panel 12.

Should the user desire to adjust the vertical alignment of the panel 12, the main brace 14 may be rotated such that the adjusting screw 34 extends thereby lengthening the main brace 14 extending between the wall plate 18 and foot plate 22. As the first pipe 24 of the main brace 14 is rotated, the rollers 72 of the knee brace bracket 10 likewise rotate, while the engagement surfaces 74, 76 prevent movement of the knee brace bracket 10 longitudinally along the first pipe 24. As such, the knee brace bracket 10 remains in engagement with the main brace 14 during vertical adjustment of the tilt-up panel 12 for assisting in the support thereof.

Figure 4:
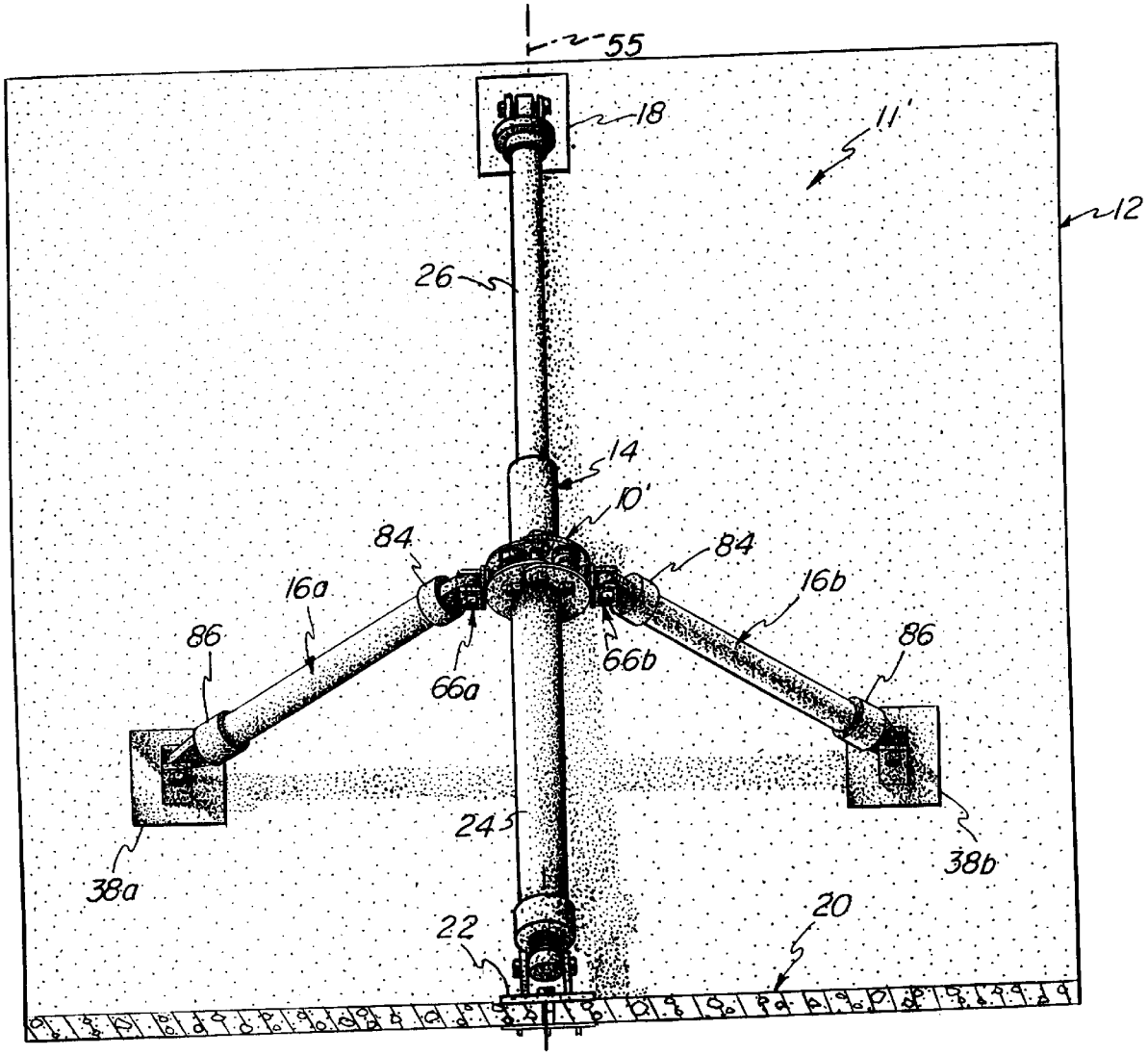
FIG. 4 is a front elevational view of the knee bracing system of the present invention showing an alternative embodiment of the knee brace bracket in use connecting a pair of knee braces to a main brace for supporting a tilt-up panel.
Figure 5:
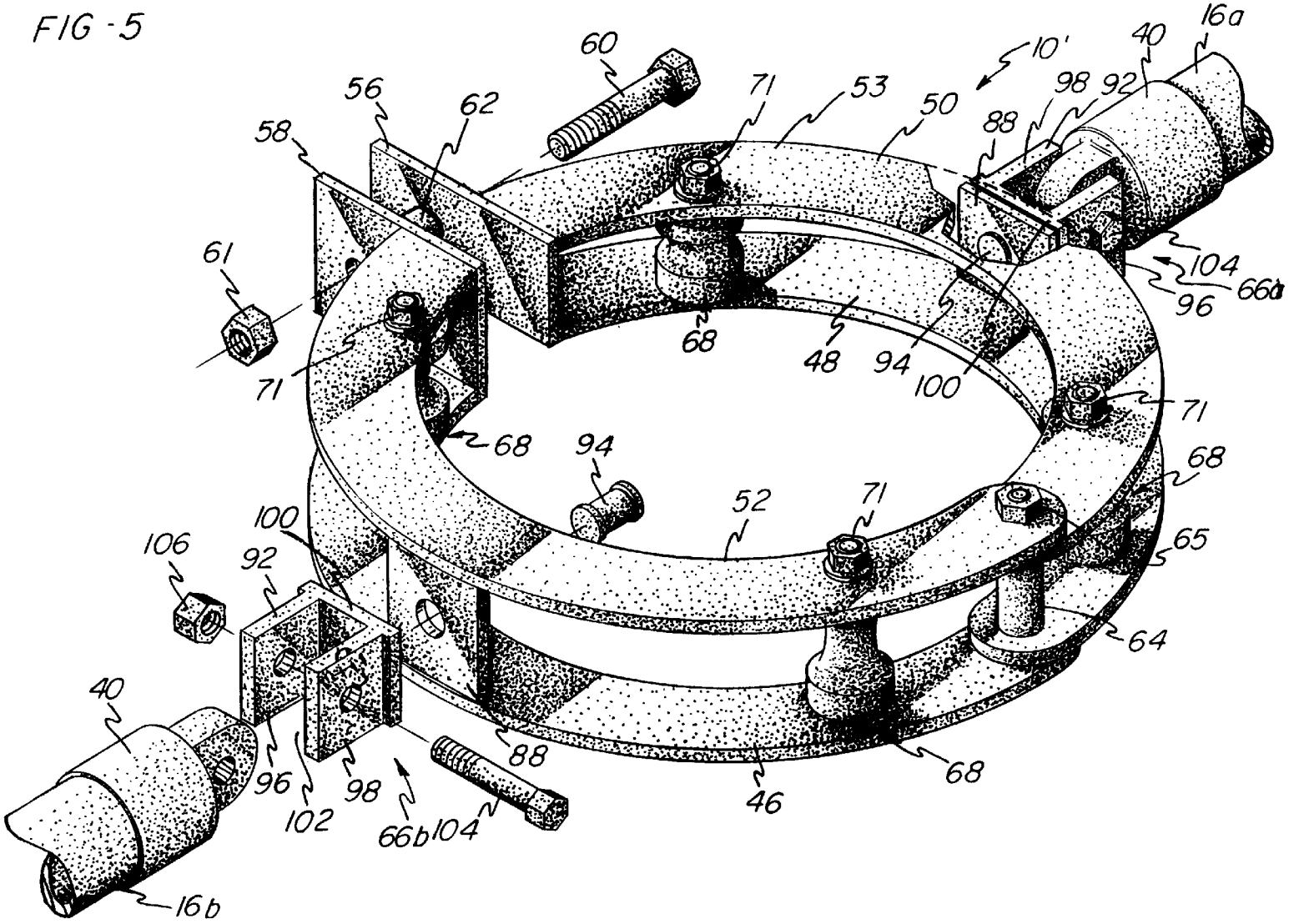
FIG. 5 is a rear perspective view of the knee brace bracket of FIG. 4, with a partial cutaway of the frame and illustrating one of the connectors partially exploded.

An alternative embodiment of the knee bracing system 11' of the present invention is illustrated in FIGS. 4 and 5. The knee brace bracket 10' includes first and second connectors 66*a* and 66*b* for pivotally supporting first and second knee braces 16*a* and 16*b*, respectively. Each knee brace 16*a* and 16*b* includes opposing first and second ends 84 and 86, wherein the first ends 84 are supported by the connectors 66*a* and 66*b*. The second ends 86 of the knee braces 16*a* and 16*b* are attached to the panel 12 at wall plates 38*a* and 38*b* positioned below the wall plate 18.

As illustrated in FIG. 4, the first and second knee braces 16*a* and 16*b* converge toward each other in a direction extending from their respective second ends 86 toward their respective first ends 84. The second ends 86 of the knee braces 16*a* and 16*b* are positioned below the knee brace bracket 10' and in spaced relation on opposite sides of a vertical plane extending perpendicular to the panel 12 and passing through the axis 55. As such, the main brace 14 and knee braces 16*a* and 16*b* cooperate to define a tripod configuration which provides added stability to the knee bracing structure 11'.

Turning now to FIG. 5, the first and second connectors 66*a* and 66*b* are fixed to the frame 53 and angularly offset from each other by approximately 180 degrees. Mounting plates 88 are fixed, preferably by welding, between the side frames 46, 48 and 50, 52. A brace support member 92 is rotatably connected to each mounting plate 88 through a swivel pin or rivet 94.

Each brace support member 92 comprises a substantially U-shaped bracket including first and second substantially parallel plates 96 and 98. A connecting plate 100, which is connected to one of the mounting plates 88 by swivel rivet 94, maintains the plates 96 and 98 in spaced relation thereby defining a slot 102. A pivot link is supported by the plates 96 and 98 and extends within the slot 102. The pivot link preferably comprises a bolt 104 which threadably engages a nut 106. A socket member 40 is pivotally supported by the pivot link and is rigidly attached to one of the knee braces 16*a* and 16*b*. As such, the knee braces 16*a* and 16*b* are supported for pivotal movement relative to the bracket frame 53 and main brace 14.

It should be apparent from the above description that the present invention provides an attachment bracket which allows a panel contractor to construct a temporary support for a tilt-up panel without requiring a crane to hold the panel in its desired vertical position. In addition, the present invention allows the panel's position to be adjusted without compromising safety.

A further benefit of the present knee brace bracket is that the bracing may be adjusted as needed after detachment of the panel from the crane. Also, the crane may be released from the panel during the initial panel erection phase earlier than prior art fixed, rigid bracing systems would permit. Thus, the present invention facilitates a reduction in the overall erection time and cost for placement of tilt-up panels.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A knee brace bracket for connecting a main brace to first and second knee braces, said knee brace bracket comprising:

a frame including a passage for receiving a main brace, said passage defining a longitudinal axis, said frame further including first and second side frames, each of said first and second side frames having opposing ends, one of said opposing ends of said first side frame pivotally connected to one of said opposing ends of said second side frame;

at least one engagement surface supported by said frame and extending into said passage, said at least one engagement surface adapted for engaging the main brace and selectively movable outwardly away from said longitudinal axis;

a first connector supported by said frame;

a second connector supported by said frame in spaced relation to said first connector; and wherein each of said first and second connectors includes a brace support member rotatably supported by said frame, each of said brace support members pivotally supporting one of the first and second knee braces.

2. The knee brace bracket of claim 1 wherein said first and second connectors are angularly offset along said frame by approximately 180 degrees.

3. The knee brace bracket of claim 1 wherein said at least one engagement surface is adapted for facilitating rotation between the main brace and said frame while simultaneously preventing relative movement between the main brace and said frame in a direction parallel to said longitudinal axis.

4. The knee brace bracket of claim 1 wherein:

each of said brace support members comprises a substantially U-shaped bracket rotatably supported by said frame;

said U-shaped bracket includes first and second substantially parallel plates and a slot defined between said first and second plates adapted for receiving the knee brace; and a pivot link extending between said first and second plates and adapted for pivotally supporting the knee brace.

5. The knee brace bracket of claim 4 further comprising a socket member pivotally connected to said pivot link within said slot between said first and second plates of said U-shaped bracket.

6. A knee brace bracket for connecting a main brace to a knee brace, said knee brace bracket comprising:

a frame defining a longitudinal axis;

at least one engagement surface supported by said frame, said at least one engagement surface adapted for engaging the main brace and adapted for facilitating rotation between the main brace and said frame while simultaneously preventing relative movement between the main brace and said frame in a direction parallel to said longitudinal axis;

a mounting plate fixed to an outer surface of said frame;

a brace support member rotatably connected to said mounting plate and extending outwardly away from said frame; and a pivot link supported by said brace support member for pivotally supporting the knee brace.

7. The knee brace bracket of claim 6 wherein said frame comprises first and second side frames, each of said first and second side frames including opposing ends, one of said opposing ends of said first side frame pivotally connected to one of said opposing ends of said second side frame whereby said at least one engagement surface may be selectively moved outwardly away from said longitudinal axis.

8. The knee brace bracket of claim 6 wherein said brace support member comprises:

a substantially U-shaped bracket including first and second substantially parallel plates spaced apart by a connecting plate; and a slot defined between said first and second plates, said pivot link extending between said first and second plates.

9. The knee brace bracket of claim 8 further comprising a socket member pivotally connected to said pivot link and received within said slot between said first and second substantially parallel plates of said brace support member.

10. A knee bracing system for use in tilt-up construction, said knee bracing system comprising:

a knee brace bracket including a frame having a passage, a first connector supported on said frame, and a second connector supported on said frame in spaced relation to said first connector;

a main brace supported within said passage of said frame, said main brace including a first pipe and a second pipe received in telescoping relationship within said first pipe;

a first knee brace pivotally supported by said first connector; and a second knee brace pivotally supported by said second connector.

11. The knee bracing system of claim 10 wherein said first and second connectors are angularly offset along said frame by approximately 180 degrees.

12. The knee bracing system of claim 10 wherein:

each of said first and second knee braces includes opposing first and second ends, said first ends supported by said first and second connectors; and said first and second knee braces converge towards each other in a direction from said second ends toward said first ends.

13. The knee brace bracket of claim 10 wherein each of said first and second connectors are rotatably supported on said frame.

14. The knee bracing system of claim 10 wherein:

said passage defines a longitudinal axis;

said first pipe is rotatably supported within said passage of said knee brace bracket; and said knee brace bracket is restricted from moving along said longitudinal axis relative to said first pipe.

15. A knee brace bracket for connecting a main brace to first and second knee braces, said knee brace bracket comprising:

a frame including a passage for receiving a main brace, said passage defining a longitudinal axis;

at least one engagement surface supported by said frame and extending into said passage, said at least one engagement surface adapted for engaging the main brace;

a first connector supported by said frame;

a second connector supported by said frame in spaced relation to said first connector;

wherein each of said first and second connectors includes a brace support member having a substantially U-shaped bracket rotatably supported by said frame, said U-shaped bracket including first and second substantially parallel plates and a slot defined between said first and second plates adapted for receiving the knee brace, and a pivot link extending between said first and second plates and adapted for pivotally supporting the knee brace; and a socket member pivotally connected to said pivot link within said slot between said first and second plates of said U-shaped bracket.

* * * * *